US009709359B1

(12) United States Patent
Robbins et al.

(10) Patent No.: US 9,709,359 B1
(45) Date of Patent: Jul. 18, 2017

(54) FIXED OPTIC FOR BORESIGHT

(76) Inventors: James Travis Robbins, Dahlgren, VA (US); Luis J. Rodriguez, King George, VA (US); Danny L. Wilson, Spotsylvania, VA (US)

( * ) Notice: Subject to any disclaimer, the term of this patent is extended or adjusted under 35 U.S.C. 154(b) by 24 days.

(21) Appl. No.: 13/374,178

(22) Filed: Dec. 5, 2011

(51) Int. Cl.
*F41G 1/393* (2006.01)
*F41G 1/44* (2006.01)
*F41G 1/50* (2006.01)
*F41F 1/06* (2006.01)

(52) U.S. Cl.
CPC ..... *F41G 1/393* (2013.01); *F41G 1/44* (2013.01); *F41G 1/50* (2013.01); *F41F 1/06* (2013.01)

(58) Field of Classification Search
CPC .... F41F 1/06; F41G 1/393; F41G 1/44; F41G 1/46; F41G 1/50; F41G 3/14; F41G 3/16; F41G 3/18; F41G 3/20; F41G 3/323; F41A 31/02
USPC ..... 42/111, 134, 120, 119; 89/41.17, 37.05, 89/41.19
See application file for complete search history.

(56) References Cited

U.S. PATENT DOCUMENTS 1,334,413 A * 3/1920 Stokes ..... F41F 1/06 89/1.35
2,010,397 A * 8/1935 Joyce ..... F41G 1/24 74/424.7
2,176,524 A * 10/1939 Denoix ..... C04B 35/01 403/129
2,478,898 A * 8/1949 Darr, Jr. ..... F41G 1/44 89/1.3
2,491,476 A * 12/1949 Brown ..... F41G 3/14 356/138
2,560,574 A * 7/1951 Herter ..... F41G 1/18 89/200
2,572,882 A * 10/1951 Roberts ..... F41G 1/44 89/200
2,581,355 A * 1/1952 Brown ..... F41G 3/14 356/138
2,876,545 A * 3/1959 Gabrusti ..... F41G 1/44 89/200
2,977,858 A * 4/1961 Jasse ..... F41G 1/30 356/138
3,256,608 A * 6/1966 Neisius ..... 33/228
3,710,675 A * 1/1973 Asikainen ..... 89/41.17
3,851,400 A * 12/1974 Michalak ..... F41G 3/14 89/206
4,026,190 A * 5/1977 Blair ..... F41G 3/14 89/200
4,121,890 A 10/1978 Braun ..... 356/4.02
4,126,394 A * 11/1978 Ulrich ..... G01B 11/26 356/138
4,168,429 A 9/1979 Lough ..... 250/330
4,232,449 A * 11/1980 Linenberger ..... F41G 1/54 33/275 R
4,292,880 A * 10/1981 Lopez ..... F41A 27/24 200/61.47

(Continued)

*Primary Examiner* — Stephen M Johnson
*Assistant Examiner* — Benjamin Gomberg
(74) *Attorney, Agent, or Firm* — Gerhard W. Thielman, Esq.

(57) ABSTRACT

A significantly simplified sight unit for a mortar is provided consisting of a gauge tool for boresight procedures containing a frame with two legs, each containing a level secured to the frame by a securing bracket. A plurality of C-brackets and screw assemblies stabilize and help further secure the levels to the frame.

16 Claims, 3 Drawing Sheets

(56) References Cited

U.S. PATENT DOCUMENTS

| | | | | | |
|---|---|---|---|---|---|
| 4,789,861 | A * | 12/1988 | Baggett | G01S 13/685 | 342/152 |
| 4,879,814 | A | 11/1989 | Wallace et al. | 89/200 | |
| 4,917,490 | A | 4/1990 | Schaffer, Jr. et al. | 356/152.1 | |
| 4,919,528 | A * | 4/1990 | Pitalo | F41G 3/323 | 356/138 |
| 5,092,071 | A | 3/1992 | Moore | 42/85 | |
| 5,586,887 | A * | 12/1996 | McNelis | F41G 3/2611 | 434/11 |
| 5,648,633 | A * | 7/1997 | Relange | F41G 3/10 | 89/200 |
| 6,449,419 | B1 * | 9/2002 | Brough et al. | 385/136 | |
| 6,973,865 | B1 | 12/2005 | Duselis et al. | 89/41.05 | |
| 7,296,358 | B1 * | 11/2007 | Murphy et al. | 33/265 | |
| 7,798,453 | B2 * | 9/2010 | Maningo et al. | 248/178.1 | |
| 8,006,427 | B2 * | 8/2011 | Blevins et al. | 89/41.17 | |
| 8,739,677 | B1 * | 6/2014 | Robbins | F41A 31/02 | 42/121 |
| 2007/0157503 | A1 * | 7/2007 | Holmberg | 42/124 | |
| 2010/0154280 | A1 * | 6/2010 | LaFrance et al. | 42/124 | |

* cited by examiner

FIXED OPTIC FOR BORESIGHT

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without the payment of any royalties thereon or therefore.

FIELD OF INVENTION

The present invention relates to the field of sight mount adjustment components, and specifically to a fixed optic for a mortar boresight.

BRIEF DESCRIPTION OF THE DRAWINGS

FIG. 0.5 is a cross-sectional view of an exemplary fixed optic boresight apparatus.

TERMINOLOGY

Figure 1:
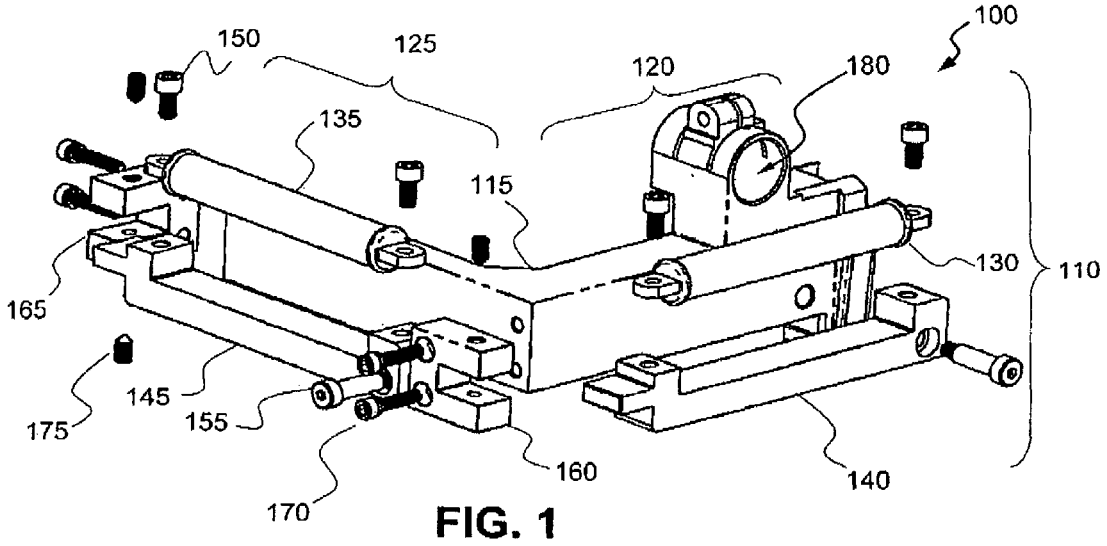
FIG. 1 illustrates an exploded view of an exemplary fixed optic boresight apparatus.

As used herein, the term "C-bracket" refers to a component having a body with two legs protruding from the body in the same direction at approximately a 90 degree angle from the body.

As used herein, the term "L-shaped" refers to a single component having two legs protruding at approximately a 90 degree angle from each other. The legs may be of equal length or of different lengths.

As used herein, the term "level vial" means a tube made of glass or some other transparent material containing a liquid and a bubble that is used to determine the horizontal or vertical orientation of an object.

As used herein, the term "securing component" refers to any structure or device used to securely attach two components. Securing components may include, but are not limited to, screws, shoulder screws, set screws, screw/lock washer assemblies, adhesives, welding, brazing, nails, bolts, and combinations of these and other structures or devices known in the art. Securing components may create permanent or temporary bonds.

BACKGROUND OF THE INVENTION

Current projectile launching weapons known in the art, such as the M327 120MM Rifled, Towered Mortar of the Expeditionary Fire Support System (EFSS), require multiple alignment components and tedious procedural adjustments to properly adjust the weapon's sight mount in order to accurately aim at a test target. For example, the M327 120MM mortar uses a sight unit and a boresight. The boresight represents the centerline of the bore, while the sight unit represents the location of the sight mount. With the reticle of the boresight aligned with the test target, using the level vials of the sight unit for additional adjustment, the reticle of the sight unit is aligned with the target within tolerance.

The sight mount therefore serves as the sole datum, or known, recognized reference point for aiming a mortar. All operations and procedures of aiming and firing the mortar function on the assumption that the sight mount is parallel to the centerline of the bore of the mortar. There is no way to check the sight mount parallelism while in the field, so it is imperative that a user can trust the sight mount calibration, usually completed by a maintainer during routine mortar maintenance. If the sight mount is out of tolerance, or not parallel, the mortar will not be aimed properly, which could result in injury or death of friendly personnel or damage and destruction of property.

Current boresights and sight units known in the art are limited in their capability to properly align a weapon with a target due to inherent errors occurring in the sight units, most of which stem from the fact that the sight unit is adjustable for field use and operations, and, while acceptable in the field, the level vials do not provide enough sensitivity to maintain tolerance objectives at the maintenance and calibration level.

The sight units use worm and bevel gears attached to measurement scales for mounting and operation, and these gears rely on spring tension to maintain proper gear engagement. While this is a common design known in the art for sight units to help mitigate the high impulse loads resulting from firing the weapon, the movement possible with existing sight units, combined with the backlash inherent in any gear train design, creates an inexact and unreliable basis for adjustment and calibration of the sight mount. The spring tension and backlash can also result in a potential loss of parallelism between the dovetail mounting surface and the telescope, since the telescope assembly to the sight unit contains multiple gear interfaces.

The level vials used in current sight units known in the art, such as the M67A1 sight unit, allow for up to ±5 mils error in adjustment, which is acceptable for mortar fire missions, but not for the precise and accurate measurements needed for sight mount adjustment. A "mil" or "gunner's mil" is a unit of measure of an angle and is the standard unit of measure for angles in the artillery field. There are 6400 mils in a 360° circle, making 1 mil equal to 0.00278°.

Because the level vials are also adjustable, further inherent error is introduced during adjustments.

The current sight unit also uses a screw traveling eccentric to the centerline of a locking collar for calibration of the level vials. While the eccentric adjustment approach allows for a more compact design and can hold an acceptable field-level tolerance, it makes level vial calibration exceedingly difficult, and opens the door for a host of calibration-related issues. In essence, an incorrectly calibrated sight unit results in an incorrectly calibrate sight mount.

Sight units known in the art are also cumbersome to use. Current sight units require two operators: one to turn the screws to adjust the sight mount, and one to read and give direction based on the bubble in the level vial. Communications between operators may also introduce additional difficulties to the alignment process.

SUMMARY OF THE INVENTION

The present invention is a significantly simplified sight unit for a mortar consisting of a gauge tool for boresight procedures containing a frame with two legs, each containing a level secured to the frame by a securing bracket. A plurality of C-brackets and screw assemblies stabilize and help further secure the levels to the frame.

DETAILED DESCRIPTION

For the purpose of promoting an understanding of the present invention, references are made in the text to exemplary embodiments of a fixed optic for boresight, only some of which are described herein. It should be understood that no limitations on the scope of the invention are intended by describing these exemplary embodiments. One of ordinary skill in the art will readily appreciate that alternate but functionally equivalent materials, components, and devices may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 is an assembly view 100 of an exemplary embodiment of fixed optic boresight apparatus 110 including a frame 115 with a front leg 120 and a side leg 125. On each leg attaches a respective level vial 130 and 135 with a corresponding level support 140 and 145. The Level vials 130 and 135 secure to their respective level supports 140 and 145 by screws 150, and shoulder bolts 155 secure the level supports 140 and 145 to the frame 115. As illustrated in view 100, the front leg 120 and side leg 125 join together at approximately a right (i.e., 90°) angle to form the frame 115.

By disposing level vials 130 and 135 on respective legs 120 and 125 as illustrated in view 100, a single person may both adjust a sight mount and read level vials 130 and 135.

As illustrated in view 100, C-brackets 160 and 165 are secured to the side leg 125 on the frame 115 by screw/locker washer assemblies 170. Set screws 175 secure the level supports 140 and 145 to their respective C-brackets 160 and 165 that serve to both anchor level vials 130 and 135 and enable calibration by their adjustment.

In the exemplary embodiment shown, the combination of set screws 175 and shoulder bolts 155 provide a simple, robust pivot-and-lock design to calibrate the level vials 135 and 140. During annual maintenance, the fixed optic boresight apparatus 110 is secured to a certified test fixture to ensure level vials 130 and 135 are properly calibrated. If the level vials 130 and 135 do not properly calibrate (e.g., show level), the set screws 175 are adjusted until level vials 130 and 135 are properly calibrated.

In the exemplary embodiment shown, the level vials 130 and 135 are glass level vials known in the art. In some exemplary embodiments, fixed optic boresight apparatus 110 may be configured with digital levels or other level sensor technology. However, the foreseeable life cycle of fixed optic boresight apparatus 110 is short, making the integration of digital technology with fixed optic boresight apparatus 110 costly.

The front leg 120 contains aperture 180, which in the exemplary embodiment shown functions as a barrel clamp. In a fully assembled unit, the aperture 180 secures a telescope through which a user looks at a target for aiming purposes. In the exemplary embodiment shown, the aperture 180 is designed to secure a M109 Elbow Telescope known in the art and used by the M67A1.

Figure 2:
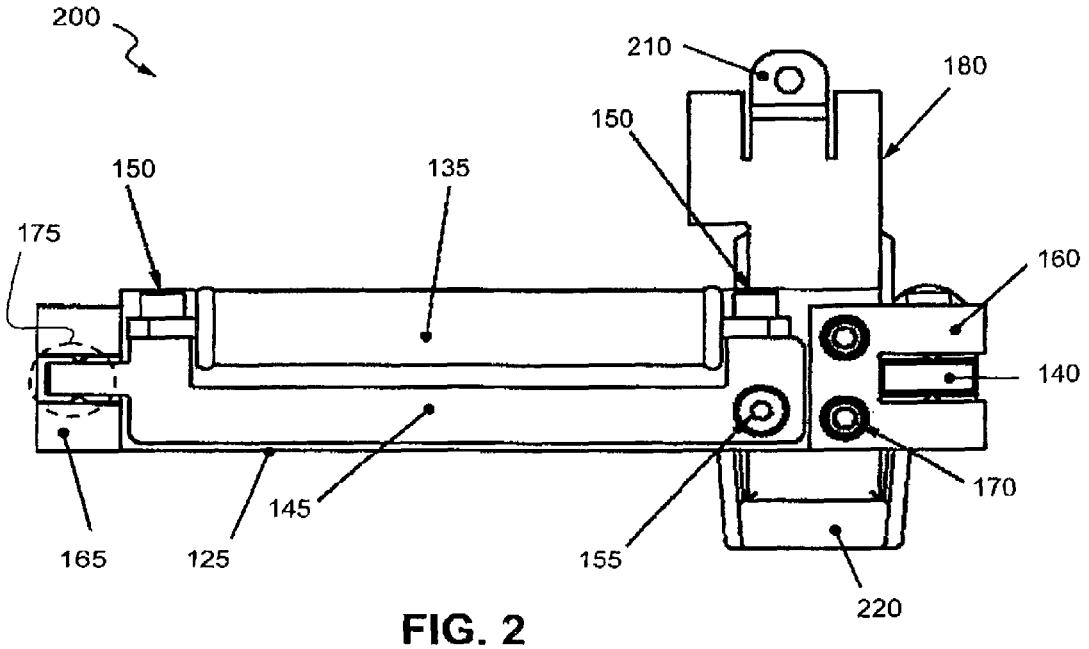
FIG. 2 is a side view of an exemplary fixed optic boresight apparatus.

Also visible in view 100, but identified in FIG. 2 is mortar attachment-bracket 220, which in the exemplary embodiment shown is a V-shaped dovetail, located adjacent to aperture 180, which engages a mortar's sight mount. In further exemplary embodiments, mortar attachment bracket 220 may be any structure known in the art to engage a mortar sight mount, including, but not limited to, hardware components (e.g., screws, brackets, clamps, braces), contours, friction-fit components and combinations of these and other structures.

The V-shape of mortar attachment bracket 220 enables the fixed optic boresight apparatus 110 to fit to weapons using the same sight mount. In further exemplary embodiments, the proximity of mortar attachment bracket 220 to aperture 180 may be adjusted to enable fixed optic boresight apparatus 110 to secure to weapons using different sight mounts. In still further exemplary embodiments, the V-shape of mortar attachment bracket 220 may be redesigned to specially accommodate a specific weapon's sight mount.

In the exemplary embodiment shown, frame 115 is fabricated from one single piece of material, thereby fixing the distance from the mortar attachment structure 185 to the aperture 180. In some exemplary embodiments, frame 115 may be fabricated with different dimensions to accommodate specific weapons. In other exemplary embodiments, frame 115 may be fabricated from multiple pieces of material or otherwise enable adjustability in the position of aperture 180.

FIG. 2 is an elevation side view 200 of an exemplary embodiment of fixed optic boresight apparatus 110 illustrating the assembled side leg 125. Level vial 135 is shown horizontally mounted to level support 145 using set screws 150. Shoulder bolt 155 secures level support 145 to frame 115 while also providing a pivot point for level vial 135 for calibration.

The C-brackets 160 and 165 are connected to the frame 115 using screw/lock washer assemblies 170. Set screws 175 are shown securing level supports 140 and 145 to the C-brackets 160 and 165 respectively at the elbow end and terminal edge of the side leg 125. The view 200 also identifies an aperture bracket 210 and the mortar attachment bracket 220 on the front leg 120. Depending on design, the distance between the aperture 180 and the bracket 220 can be fixed or adjustable.

Figure 3:
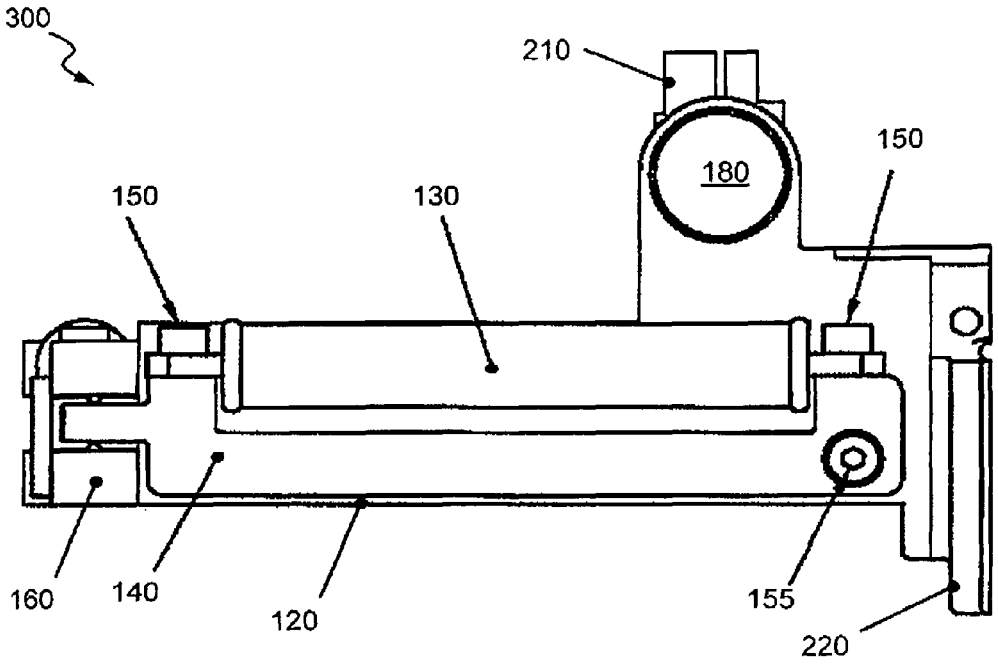
FIG. 3 is a front view of an exemplary fixed optic boresight apparatus.

FIG. 3 is an elevation front view of an exemplary embodiment of fixed optic boresight apparatus 110 illustrating the assembled front leg 120 with aperture 180. The level vial 130 is secured and horizontally mounted to level support 140 using screws 155. The shoulder bolt 155 secures level support 140 to the frame 115 while also providing a pivot point for level vial 140 for calibration. C-bracket is shown secured to frame 115, with set screws 175 securing level support 140.

Figure 4:
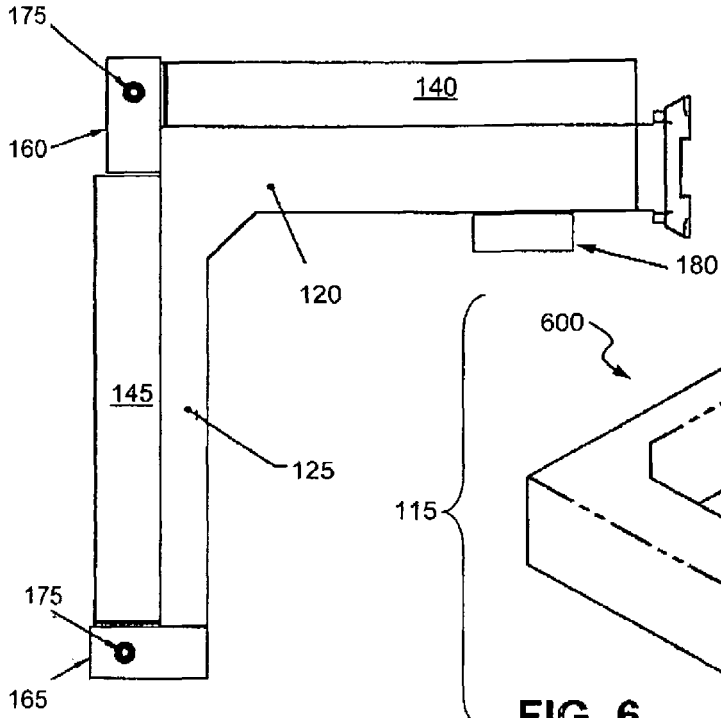
FIG. 4 is a bottom view of an exemplary fixed optic boresight apparatus.

FIG. 4 is a plan bottom view 400 of an exemplary embodiment of fixed optic boresight apparatus 110. The front leg 120 with level support 140 and side leg 125 with level support 145 are shown with bottom set screws 175. The C-brackets 160 and 165 are also shown in view 400, with along with the corresponding supports 140 and 145, being adjustable on the side leg 125.

Figure 5:
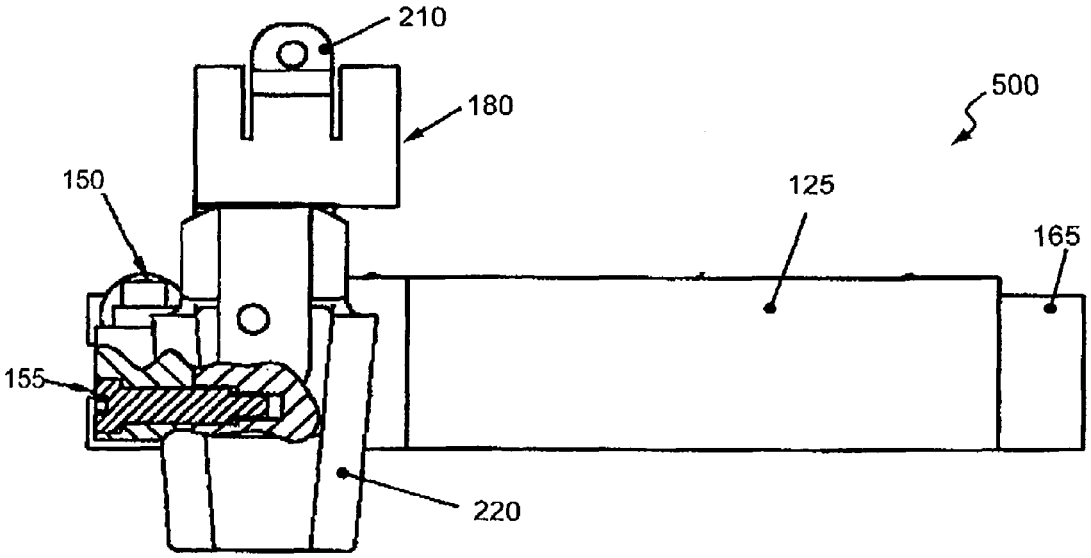
Figure 6:
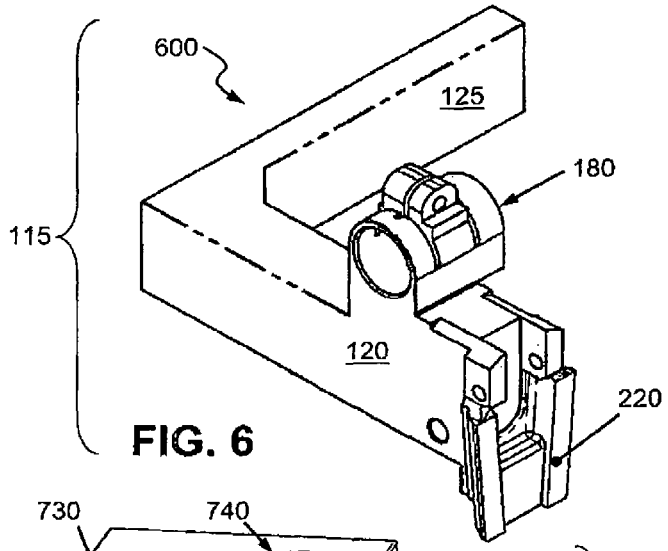
FIG. 6 is an isometric view of a frame with front and side legs.
Figure 7:
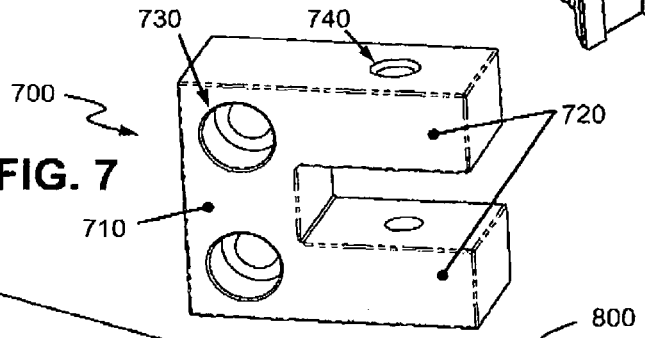
FIG. 7 is an isometric view of a C-bracket.

FIG. 5 is an elevation partial cross-sectional view 500 of an exemplary embodiment of the fixed optic boresight apparatus 110, showing a cross section taken along front leg 120, which illustrates the screw 150 and shoulder bolt 155. FIG. 6 is an isometric view 600 of the frame 115 with the front leg 120 and the side leg 125. FIG. 7 is an isometric view 700 of one of the C-brackets 160, which a bridge 710 and two parallel arms 720 extending therefrom. A parallel pair of shouldered orifices 730 enable a corresponding pair of screws 150 to pass therethrough to secure the C-bracket 160 to the front leg 120. A co-linear pair of countersink orifices 740 through the arms 720 enable the set screws 175 to pass through to secure the C-bracket 160 to the corresponding level support 140.

Figure 8:
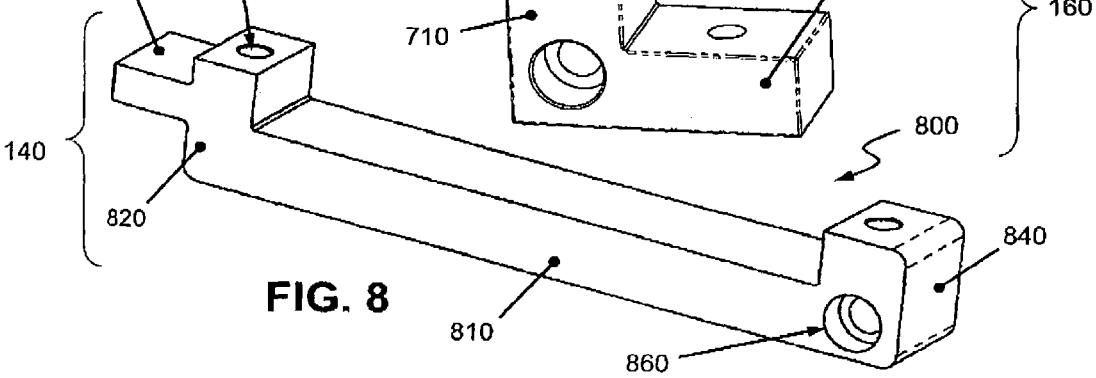
FIG. 8 is an isometric view of a level support.

FIG. 8 is an isometric view 800 of one of the level supports 140, including a beam member 810 that terminates on the left side by a first block 820 and an extending tang 830 or flange that engages with C-clamp 160 between the arms 720 and on the right by a second block 840. The blocks 820 and 840 include orifices 850 through which the screws 150 pass through. The second block 840 also includes a shouldered orifice 860 through which the shoulder bolt 155 passes therethrough to secure the level support 140 to the front leg 120.

As illustrated in FIGS. 1 through 8, frame 115, level supports 140 and 145 and C-brackets 160 and 165 are specifically machined out of solid carbon steel for the fixed optic boresight apparatus 110. In further exemplary embodiments, frame 115, level supports 140 and 145 and C-brackets 160 and 165 may be hollowed. In still further exemplary embodiments, fixed optic boresight apparatus 110 may be altered to use off-the-shelf components.

While in the exemplary embodiments described, components of fixed optic boresight apparatus 110 are machined from steel, such as low grade carbon steel, in further exemplary embodiments, components of fixed optic boresight apparatus 110 may be machined or manufactured from cast iron. However, in further exemplary embodiments, other materials, such as high-grade steels, high-grade aluminums, and other exotic materials, may be used. In still further exemplary embodiments, any material which may be machined to the required tolerances and withstands the required surface finish without damage may be used. Materials for fixed optic boresight apparatus 110 must also be dimensionally stable (e.g., not warp, develop bends, relax or lose bolt torque) through a wide range of temperatures and not experience material failure due to age or exposure like plastics, which become brittle as the material ages. In yet further exemplary embodiments, components of fixed optic boresight apparatus 110 may be made from different materials.

In the exemplary embodiments illustrated in FIGS. 1 through 8, fixed optic boresight apparatus 110 is a hardware component adapted to be secured to a mortar's sight mount. In further exemplary embodiments, fixed optic boresight apparatus 110 may be configured with software or coupled with sensors, recording devices, transmission devices, or data-receiving devices to provide feedback to personnel regarding a mortars performance and alignment. For example, in some exemplary embodiments, fixed optic boresight apparatus 110 may be configured or coupled with a global positioning system (GPS) system, video/audio recording devices, or digital levels. In still further exemplary embodiments, information received from sensors coupled with fixed optic boresight apparatus 110 may be used as feedback to adjust the positioning of a mortar's sight unit.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A fixed optic boresight apparatus for a mortar having a sight mount, said apparatus comprising:

an L-shaped frame unit comprising a front leg and a side leg, said front leg containing an aperture, said front and side legs joining at an elbow substantially perpendicular to each other;

first and second level vials, said first vial connectable to and substantially in parallel with said front leg, and said second vial connectable to and substantially in parallel with said side leg;

an attachment interface disposed on said front leg opposite said elbow for attaching to the sight mount of the mortar;

first and second securing brackets that correspond to said first and second level vials, each of said securing brackets receiving said corresponding level vials and attaching respectively to said front and side legs by a plurality of securing components; and first and second C-brackets secured to said frame unit respectively adjacent said elbow and at an end edge of said side leg and that attach corresponding said first and second securing brackets, each said C-bracket having a bridge and two substantially parallel arms that extend therefrom, said bridge attaching to said frame unit and said arms connecting to a tang on corresponding said securing brackets.

2. The apparatus of claim 1 wherein said level vials are digital levels.

3. The apparatus of claim 1 wherein said level vials are mounted substantially parallel to said securing brackets.

4. The apparatus of claim 1 wherein said attachment interface is disposed to have a mounting surface at a fixed distance from said aperture.

5. The apparatus of claim 1 wherein said frame unit is a singly machined component.

6. The apparatus of claim 1 wherein said frame unit has a hollow interior.

7. The apparatus of claim 1 wherein said aperture includes a barrel clamp for securing a telescope within said aperture.

8. The apparatus of claim 1 wherein said front leg and said side leg form a substantially 90° angle.

9. The apparatus of claim 1 wherein said frame unit is machined from a material selected from the group consisting of low grade carbon steel, cast iron, high-grade steel, high grade aluminum and combinations thereof.

10. The apparatus of claim 1 coupled with at least one sensor device selected from the group consisting of video recording devices, sound recording devices, transmission devices, receiving devices, GPS and combinations thereof.

11. A fixed optic boresight apparatus for a mortar having a sight mount, said apparatus comprising:

an L-shaped frame unit with a front leg and a side leg, wherein said front leg contains an aperture, said front and side legs joining at an elbow substantially perpendicular to each other;

first and second securing brackets attaching to said frame unit with a plurality of shoulder bolts, wherein said first securing bracket engages said front leg and said second securing bracket engages said side leg;

first and second level vials that respectively attach substantially parallel to said first and second securing brackets;

first and second C-brackets, said first C-bracket being secured to said side leg adjacent said elbow, and said second C-bracket being secured to an edge end of said side leg, both said C-brackets being attached to said side leg with a plurality of screw-and-lock washer assemblies;

wherein said first securing bracket engages said first C-bracket and said second securing bracket engages said second C-bracket; and an attachment interface disposed on said front leg opposite said elbow for attaching to the sight mount of the mortar.

12. The apparatus of claim 11 wherein said front leg and said side leg form a substantially 90° angle.

13. The apparatus of claim 11 wherein said aperture includes a barrel clamp for securing a telescope within said aperture.

14. The apparatus of claim 11 wherein said attachment interface is a V-shaped dovetail.

15. The apparatus of claim 11 wherein said attachment interface is disposed to have a mounting surface at a fixed distance from said aperture.

16. The apparatus of claim 11 wherein each said securing bracket has a beam and a tang extending therefrom, each said C-bracket has a bridge and two substantially parallel arms extending therefrom, said bridge attaching to said frame unit and said arms connecting to said tang on corresponding said securing brackets.

* * * * *